US007147103B2

(12) United States Patent
Retelski

(10) Patent No.: US 7,147,103 B2
(45) Date of Patent: Dec. 12, 2006

(54) CIGARETTE PACK WITH CIGARETTE ELEVATION CAPABILITY

(76) Inventor: Marian Retelski, 94-98 Nassau Ave. #258, Brooklyn, NY (US) 11222

( * ) Notice: Subject to any disclaimer, the term of this patent is extended or adjusted under 35 U.S.C. 154(b) by 153 days.

(21) Appl. No.: 10/975,506

(22) Filed: Oct. 29, 2004

(65) Prior Publication Data

US 2005/0167299 A1 Aug. 4, 2005

Related U.S. Application Data

(60) Provisional application No. 60/540,549, filed on Jan. 30, 2004.

(51) Int. Cl.
*B65D 85/10* (2006.01)
*A24F 15/00* (2006.01)

(52) U.S. Cl. ..... 206/250; 206/254; 206/249; 229/87.13

(58) Field of Classification Search ..... 206/242, 206/249–255, 268, 273; 229/87.13
See application file for complete search history.

(56) References Cited

U.S. PATENT DOCUMENTS 1,749,386 A * 3/1930 Martin ..... 206/254
1,902,963 A * 3/1933 Lepage et al. ..... 206/254
2,072,796 A * 3/1937 Christopher ..... 206/254
2,258,170 A * 10/1941 Austin et al. ..... 206/254
2,339,924 A * 1/1944 Hadley ..... 221/260
2,346,407 A * 4/1944 Wright ..... 206/254
2,849,154 A * 8/1958 Gartrell et al. ..... 206/254
2,935,228 A * 5/1960 Cosby, Jr. et al. ..... 221/260
4,240,548 A * 12/1980 Stio ..... 206/250
5,435,439 A * 7/1995 Swart ..... 206/255

FOREIGN PATENT DOCUMENTS

EP 928751 A1 * 7/1999

* cited by examiner

*Primary Examiner*—Mickey Yu
*Assistant Examiner*—J. Gregory Pickett
(74) *Attorney, Agent, or Firm*—Clifford G. Frayne

(57) ABSTRACT

A lift mechanism for use with a "hard pack" of cigarettes wherein the "hard pack" of cigarettes consists of a housing having four side walls and a bottom wall, a prismatic lid hingeably secured to one of the upper ends of the side walls and a quantity of cigarettes encapsulated in a tear open foil wrap, the lift mechanism positioned within the foil wrap, the lift mechanism having a horizontal planar leg positioned between the foil wrap bottom wall and the cigarettes encapsulated in the foil wrap, the lift mechanism defining a planar surface beneath the cigarettes and at least one vertical surface, the vertical surface secured to a cord, the cord extending upwardly and being secured to the upper inner surface of the prismatic lid such that opening the prismatic lid tensions the cord and raises the lift member elevating a portion of the cigarettes.

9 Claims, 6 Drawing Sheets

CIGARETTE PACK WITH CIGARETTE ELEVATION CAPABILITY

RELATED APPLICATIONS

Applicant claims the benefit of provisional application 60/540,549, filed Jan. 30, 2004.

BACKGROUND OF THE INVENTION

1. Field of the Invention

The present invention relates to a cigarette pack and particularly, a "hard pack" of cigarettes having a hingeable top, and more particularly, to an elevational mechamism within the cigarette pack cooperable with the hingeable top to elevate cigarettes from the pack to facilitate the removal of a cigarette.

2. Description of the Prior Art

Cigarettes are normally packaged in a quantity of 20 per pack. There are two main types of cigarette packs utilized on the market. The first, the "soft pack" requires the user to remove the wrapping and the to tear or unfold the foil layer from the top of the pack to gain access to the cigarettes. The second type of pack is commonly referred to ad the "hard pack" which is normally fabricated of a cardboard more rigid than the "soft pack" and is usually formed with a hingeable top so as to enclose the cigarettes when not in use. Cigarettes in a "hard pack" are also encapsulated in foil wrap within the "hard pack" necessitating a tear or unfolding to gain access.

With the "soft pack" package, the user can remove the foil from the upper end of the package and tap the upper end of the pack against his hand in order to cause a cigarette to be slidably dislodged from the pack so that it may be grasped by the fingers. This procedure is difficult to do with a "hard pack" because of the hingeable lid.

Once the first several number of cigarettes have been removed from the pack, subsequent cigarettes are more easily removed because there is now a vacant space or void between the cigarettes as a result of the removal of the initial cigarettes.

Applicant's invention relates to a lifting mechanism cooperable and mounted in the "hard pack" box which will automatically lift cigarettes upwardly whenever the hinged lid is open, which is particularly advantageous when the pack is first opened. Applicant's lifting mechanism has two advantages, first, it makes the upper end of initial cigarettes from the pack more accessible for a more facile removal from the box. Secondly, with the cigarettes in a lifted or elevated position, the user can remove or offer a single cigarette without having his fingers or the other persons contacting other cigarettes which will remain within the "hard pack" and thus achieve a greater degree of hygiene.

OBJECTS OF THE INVENTION

An object of the invention is to provide for a novel cigarette pack which will elevate the cigarettes within the pack whenever the hinged top is pivoted so as to allow more facile access to the cigarettes.

Another object of the present invention is to provide for a novel cigarette pack which will automatically lift or elevate the cigarettes within the pack whenever the hinged lid is pivoted and allow access to a cigarette without having to contact other cigarettes which may remain in the package.

A still further object of the present invention is to provide for a novel cigarette pack having a lifting mechanism of low cost and which is easily installed in the cigarette pack without increasing the cost of the packaging.

A still further object of the present invention is to provide for a novel cigarette pack wherein the lifting mechanism in cooperation with the package lid on the cigarette pack lifts a portion quantity of cigarettes within the package each time the hingeable lid is pivoted.

SUMMARY OF THE INVENTION

A lift mechanism for use with a "hard pack" of cigarettes wherein the "hard pack" of cigarettes consists of a housing having four side walls and a bottom wall, a prismatic lid hingeably secured to one of the upper ends of the side walls and a quantity of cigarettes encapsulated in a tear open foil wrap, the lift means consisting of a lift member positioned within the foil wrap, the lift member having a horizontal planar leg positioned between the foil wrap bottom wall and the cigarettes encapsulated in the foil wrap, at least one planar vertical leg positioned between the foil wrap rear wall and the cigarettes abutting thereto, the lift member defining a planar surface beneath the cigarettes and, at least one vertical surface juxtaposed the tubular sides of the cigarettes, the vertical surface having secured thereto a cord, the cord extending upwardly and being secured to the upper inner surface of the prismatic lid such that opening the pack by pivoting the prismatic lid tensions the cord and raises the lift member upwardly elevating a portion of the cigarettes.

BRIEF DESCRIPTION OF THE DRAWINGS

These and other objects of the present invention will become apparent, particularly when taken in light of the following illustrations wherein.

DETAILED DESCRIPTION OF THE INVENTION

Figure 1:
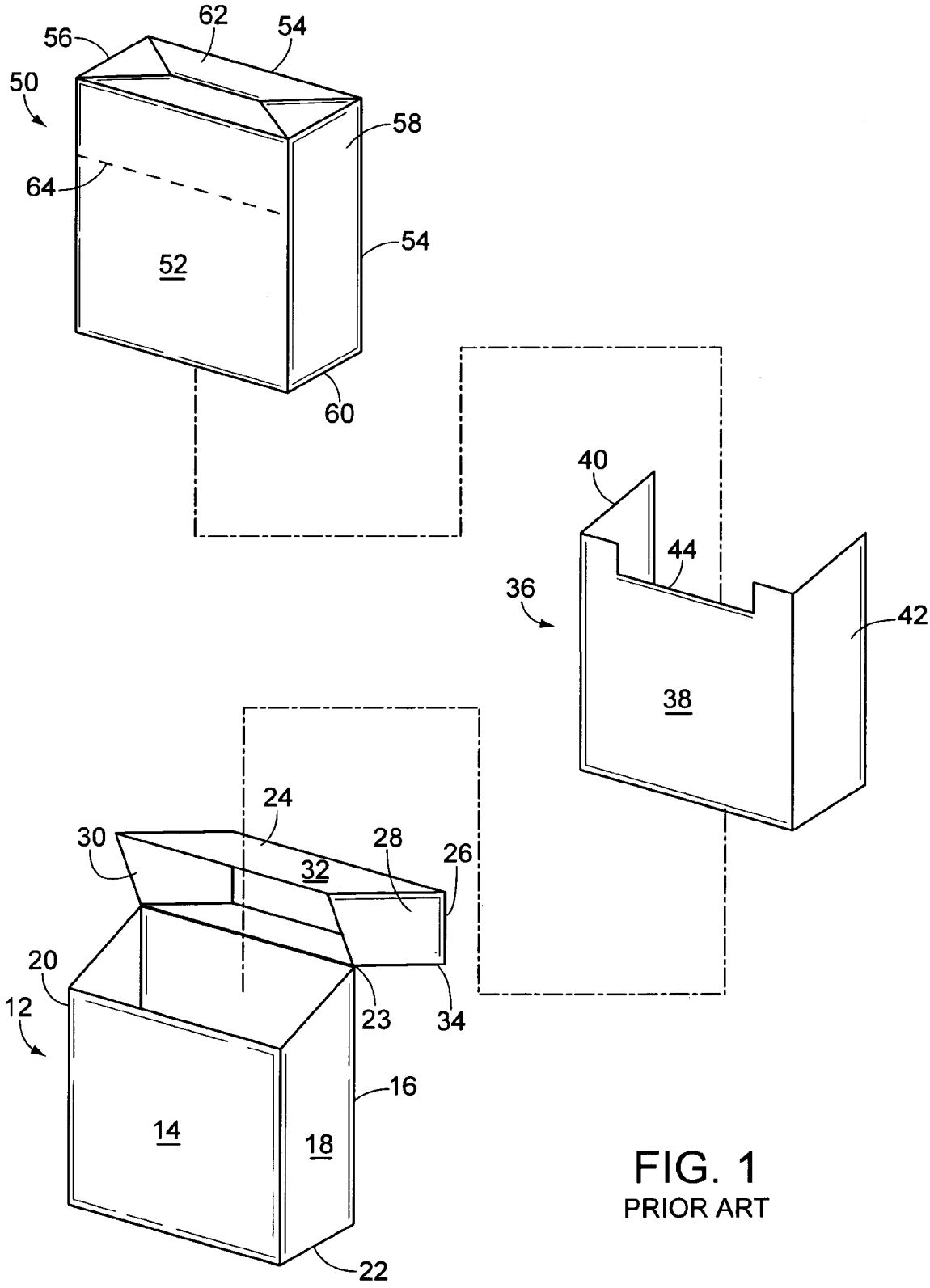
FIG. 1 PRIOR ART
FIG. 1 is a perspective exploded view of a "hard pack" cigarette pack of the prior art.

FIG. 1 is a perspective exploded view of a typical "hard Pack" cigarette pack 10 of the prior art. The "hard pack" cigarette pack is formed with an outer housing 12 defined by a front wall 14, rear wall 16, and joined by two side walls 18 and 20, and a bottom wall 22. The rear wall 16 of housing 12 terminates with a unitary prismatic hinged lid 24 defined by a seam 23, top wall 26, trapezoidal side walls 28 and 30, a front wall 32 and a rear wall 34. When the prismatic hinged lid 24 is in a closed position, the prismatic hinged lid 24 and outer housing 12 define the cigarette pack 10. Inserted within the cigarette pack 10 is a sleeve member 36 defined by a front wall 38, and side walls 40 and 42, the sleeve member 36 slidably insertable into the outer housing 12 with the sleeve members front wall 38 and side walls 40 and 42 juxtaposed the inner surface of the front 14 and side walls 18 and 20 of the outer housing 12. The front wall 38 and sidewalls 40 and 42 extend above the upper edges of front wall 14 and side walls 18 and 20 of outer housing 12. The front wall 38 of the sleeve member 36 is stepped downwardly from both side walls 40 and 42 to form a U-shaped gap 44 to permit access to the cigarettes or smoking articles enclosed therein.

A folded foil wrap 50 encapsulating the cigarettes is insertable within the sleeve member 36, the foil wrap 50 being defined by a front wall 52, a rear wall 54, two side walls 56 and 58, a bottom wall 60 and a folded top wall 62. The rear wall 54 of the foil wrap is typically adhesed to the inner surface of rear wall 16 of the outer housing 12.

Figure 2:
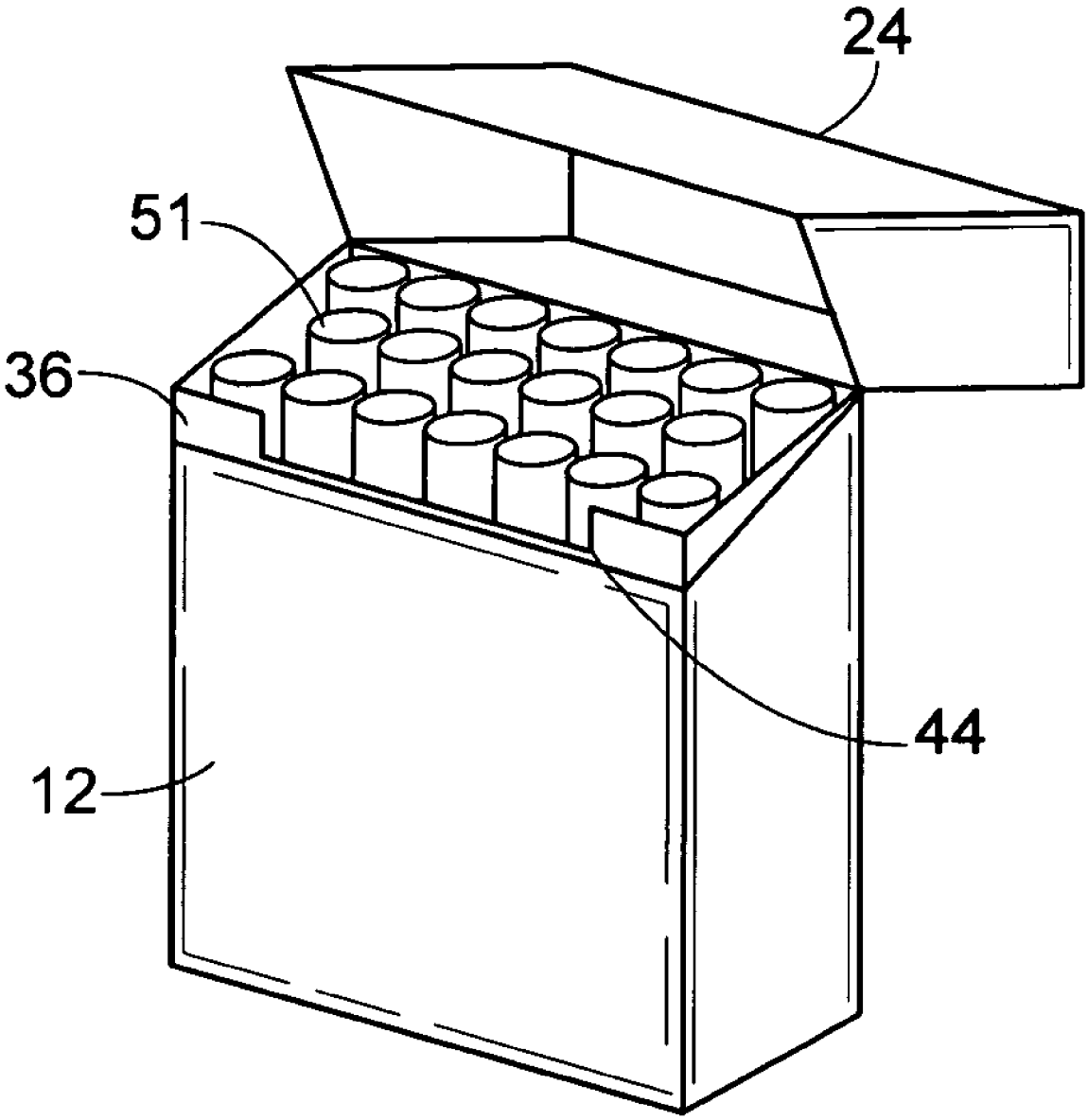
FIG. 2 PRIOR ART
FIG. 2 is a perspective view of the assembled cigarette pack in open orientation of FIG. 1.

When the top wall 62 of the foil wrap 50 is unfolded, a portion of the front wall 52 which forms the folded top wall 62 can be pulled upwardly and the upper portion of the front wall 52 can be separated from the lower portion of the front wall 52 by means of a perforation 64 running horizontally along the front wall 52. When this upper portion of the front wall 52 is removed, the user has access to the cigarettes 51 packed within the foil wrap 50 by means of the U-shaped gap 44 formed in the front wall 38 of the sleeve member 36 (See FIG. 2). Typically the filter ends of the cigarettes are exposed at this point, the cigarettes being packed within the foil wrap 50, insertable within the sleeve member 36 and outer housing 12 in three rows, normally including a row of seven cigarettes, a second row of seven cigarettes and third row of six cigarettes, the third row being proximate the rear wall 16 of the outer housing 12.

In this configuration (FIG. 2) when the cigarette pack 10 is initially opened, the cigarettes are tightly packed within the foil wrap 50, sleeve member 36 and outer housing 12. The tubular sidewalls of the cigarettes are in abutting contact with adjacent cigarettes and those cigarettes about the periphery are in abutting contact with the foil wrap, sleeve member and outer housing 12. In order to remove a cigarette, often times requires the contact with several adjacent cigarettes through U-shaped gap 44 to remove the first cigarette. This presents an unhygienic situation, particularly if the user is offering a cigarette to a friend or the user is removing a cigarette for his own use and then intends to offer a cigarette to a friend. It also presents a problem in removing the first cigarette or cigarettes from the pack without damaging them.

Figure 3:
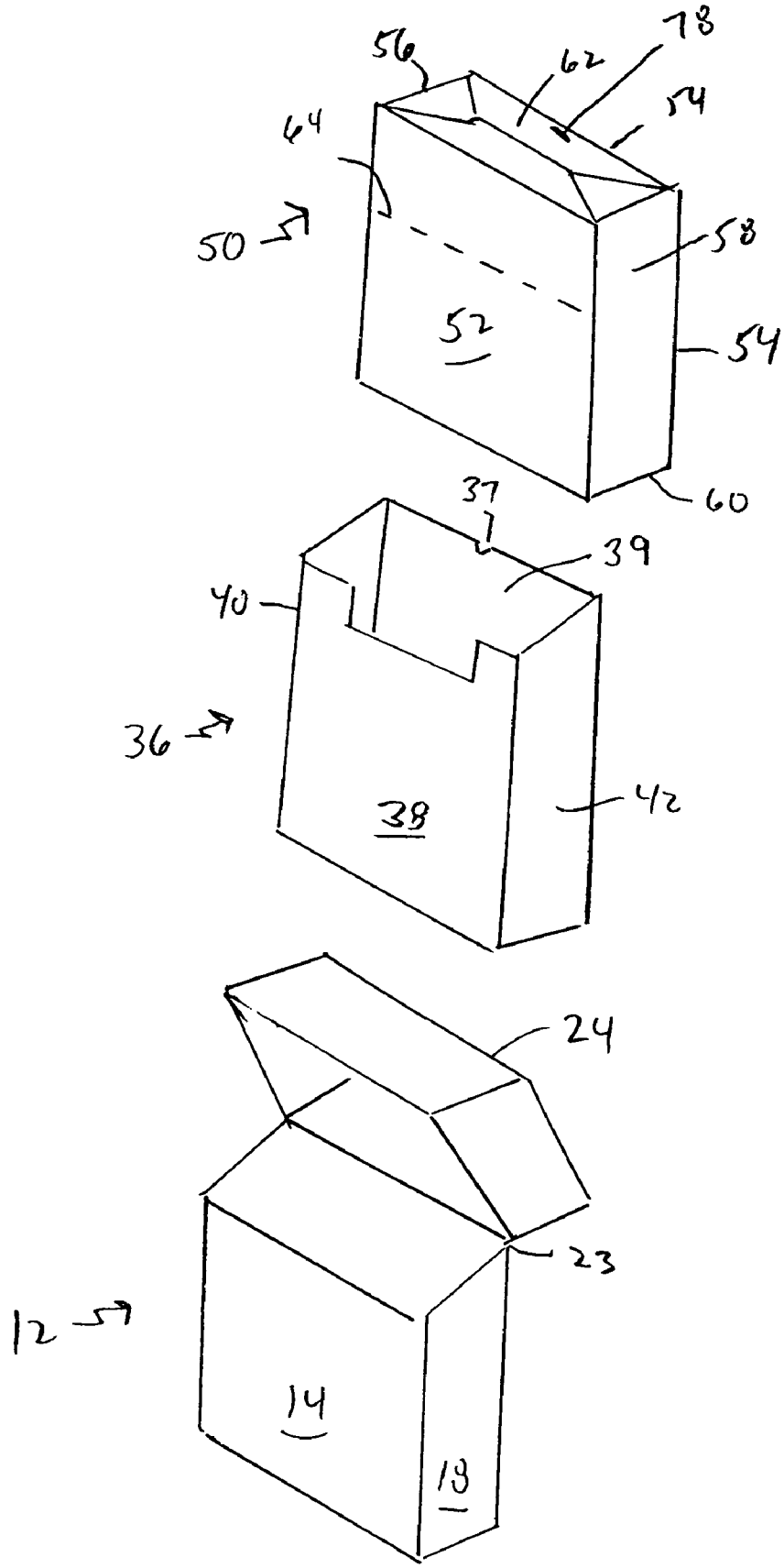
FIG. 3 is a perspective exploded view of a "hard pack" cigarette pack of the present invention.
Figure 4:
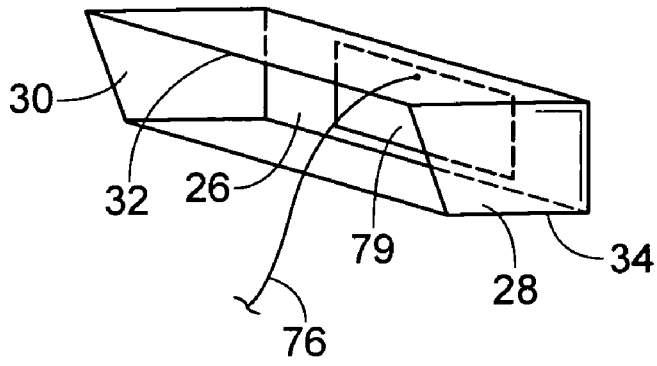
FIG. 4 is a perspective view of the prismatic hingeable lid of the cigarette pack of the present invention.
Figure 5:
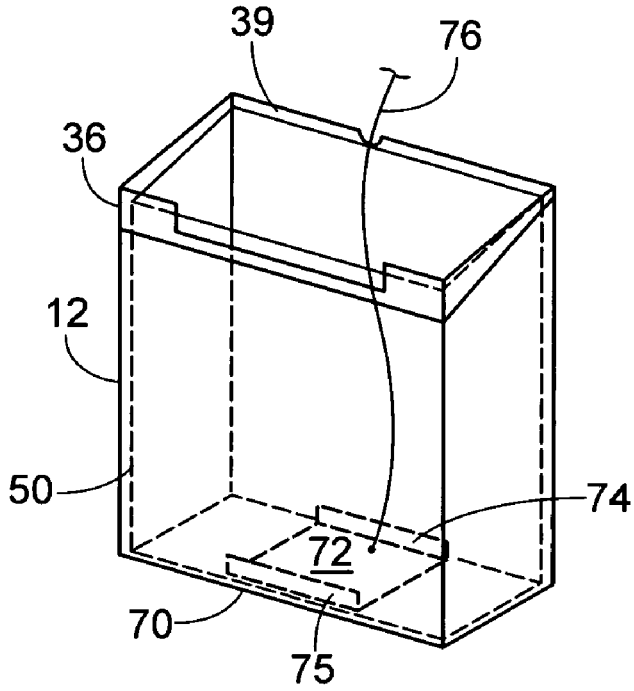
FIG. 5 is a cutaway view of the lower portion of the cigarette pack of FIG. 3 illustrating the lifting mechanism.
Figure 6:
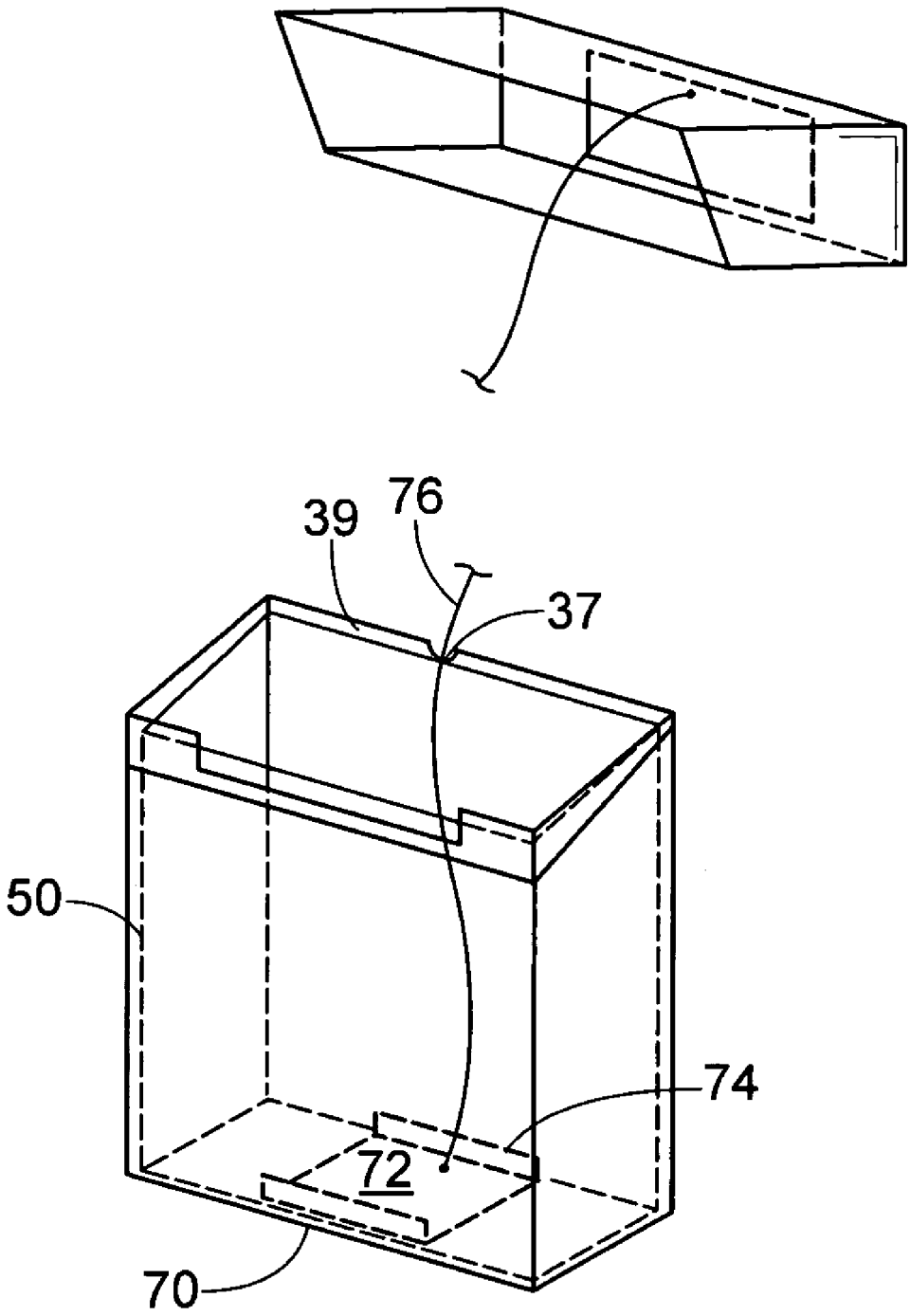
FIG. 6 is a perspective cutaway view of the lower portion of the cigarette pack illustrating a second embodiment of the lifting mechanism.
Figure 7:
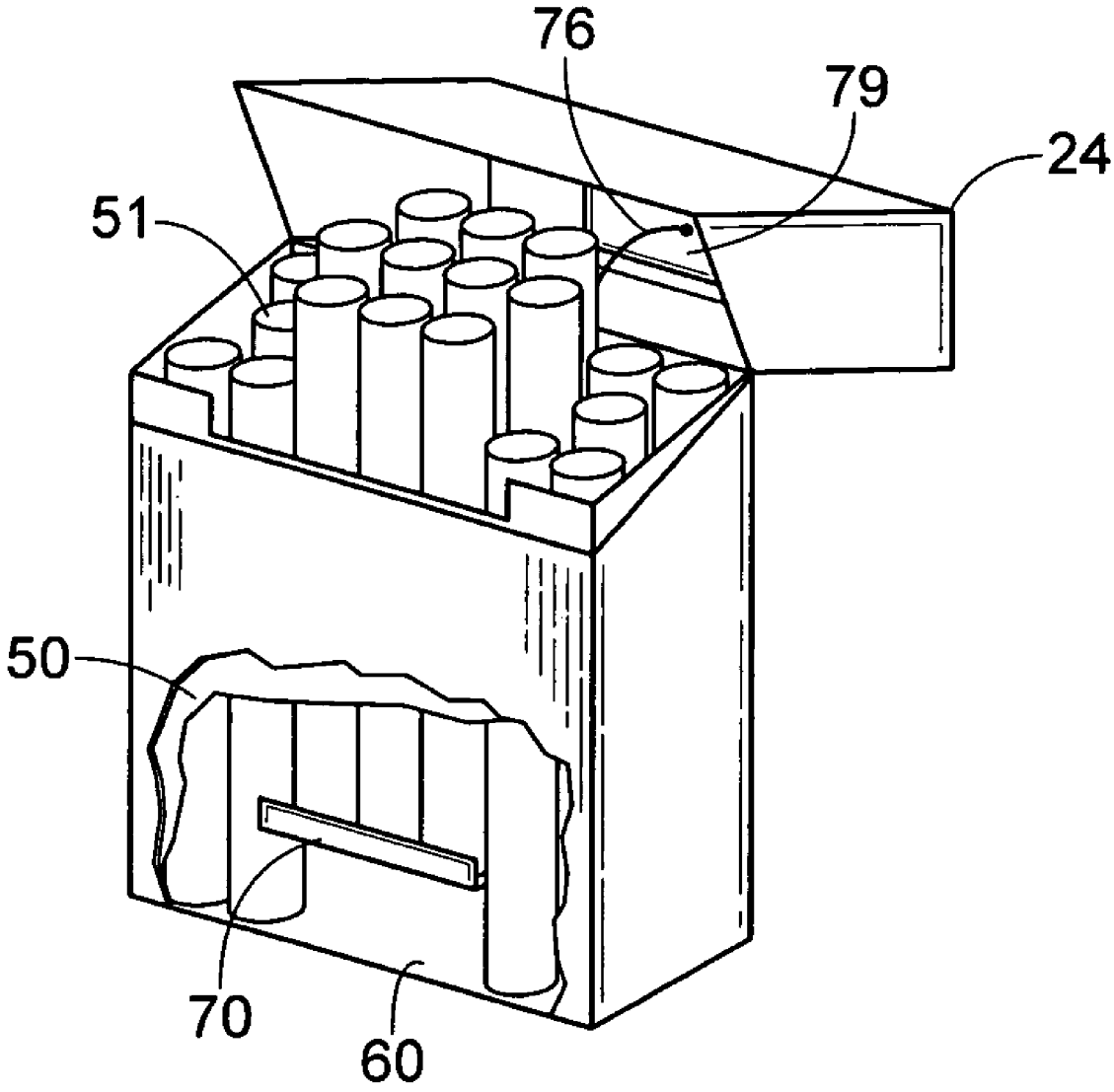
FIG. 7 is a perspective cutaway view of the lifting mechanism of the present invention in operation with a pack of cigarettes.

FIG. 3 is a perspective exploded view of a "hard pack" of cigarettes of the present invention incorporating Applicant's lift mechanism. FIG. 4 is a perspective view of the prismatic hingeable cover of the cigarette pack of the present invention. FIG. 5 is a cutaway view of the lower portion of the cigarette pack of FIG. 3 illustrating the lifting mechanism, and FIG. 6 illustrates a second embodiment of the lifting mechanism. FIG. 7 illustrates the lifting mechanism in operation.

In order to incorporate the lifting mechanism operation of Applicant's invention, certain minor modifications must be made to the cigarette pack 10 of the prior art. It will be noted in FIG. 1 that the actual cavity in which the foil wrap 50 and encapsulated cigarettes are slidably received is defined by the front 30 and side walls 40 and 42 of the sleeve member 36 and the rear wall 16 of the outer housing 12. The side walls 40 and 42 of the sleeve member extend upwardly above the side walls 18 and 20 of the outer housing 12 so that the upper edges of side walls 40 and 42 of sleeve member 36 are juxtaposed the top 26 of the prismatic lid 24 when closed. In the preferred embodiment of Applicant's invention, sleeve member 36 would have a rear wall 39 secured to said side walls 40 and 42 of sleeve member 36, the rear wall 39 of the sleeve member 36 extending to a height equal to the height of the side walls 40 and 42 of the sleeve member 36. The rear wall 39 of the sleeve member 36 and the height thereof define a fulcrum point for the operation of Applicant's lift mechanism, which can be enhanced by a notch 37.

Referring to FIG. 4 there is a perspective view of Applicant's prismatic hingeable lid and FIG. 5 illustrates a cutaway view of the lower portion of the cigarette pack of the present invention as illustrated in FIG. 3. Applicant's lift mechanism provides for a plate member 70 defined by a horizontal member 72 and a vertical members 74 and 75. The plate member 70 is positioned within foil wrap 50 adjacent the bottom wall 60 of the foil wrap 50 with the horizontal member 72 juxtaposed the bottom wall 60 and the vertical members 74 and 75 juxtaposed the rear wall 54 and front wall 52 of the foil wrap 50. The plate member 70 has secured thereto a string, cord, or other flexible communication member 76 preferably secured to horizontal member 72 but alternatively secured to rear vertical member 74. The string or cord extends upwardly juxtaposed the rear wall 54 of the foil wrap 50, through a slit 78 in that portion of the foil wrap 50 which is foldable to define the top wall 62 of the foil wrap 50, extends over rear wall 39 of sleeve member 36, and is secured at its opposing end to the inner surface of the top wall 26 of the prismatic hinge lid 24. To insure its security to the inner surface of the top wall 26 of the prismatic hingeable lid 24, the opposing end of cord 76 is overlaid with a securing member 79 which is secured to this inner surface by adhesive or other similar means.

Plate member 70 may be fabricated of a thin, yet rigid material, such as aluminum blade or plastic. The cigarettes 51 are positioned within the foil wrap 50 once plate member 70 has been positioned as detailed herein.

In the course of manufacturing the cigarette pack 10 the outer housing 12 and sleeve member 36 would be assembled, the foil wrap 50 would be positioned and the cigarettes 51 encapsulated by the foil wrap 50 with the foil wrap 50 top wall 62 folded to encapsulate the cigarettes. The prismatic hingeable lid 24 would then be positioned in a closed position and the entire pack of cigarettes would be encapsulated in cellophane wrap for sale.

In operation, (See FIG. 7) the user would remove the outer cellophane wrap and open the prismatic hinged lid 24 to remove the tearable foil. In pivoting the hinged lid 24, the cord 76 running over notch 37 would become taut and would raise plate member 70 adjacent the bottom wall of the foil wrap 50, thus lifting that portion of the quantity of cigarettes within the pack 10 whose bottom ends rested on the horizontal member 72 of plate member 70 upwardly a few millimeters to facilitate the user in grasping a single cigarette 51 for removal. The folded foil wrap 50 which forms the top wall 62 of the foil wrap enclosure is not sealed so it does not exert any significant force on the top of the cigarettes being lifted.

When the prismatic hingeable lid 12 is closed, plate member 70 returns to its original position with horizontal member 72 being juxtaposed the bottom wall 60 of the foil wrap.

The lift mechanism serves its purpose of elevating a portion of the quantity of cigarettes within the pack each time the prismatic hingeable lid is opened. It will be recognized by those of ordinary skill in the art that once a portion of the cigarettes 51 have been removed from the cigarette pack 10, voids exist between the remaining cigarettes 51 which were originally tightly packed within the cigarette pack 10. Therefore, while the lift mechanism may continue to perform the desired function, the ability to remove a single cigarette from the package after a portion have been removed, does not require the operation of the lift mechanism.

FIG. 6 illustrates a second embodiment of lift mechanism in which plate member 70 includes only one vertical member 74 juxtaposed rear wall 54 of foil wrap 50 yet operates in the same fashion as the first embodiment. FIG. 6 also illustrates the alternative positioning of cord 76 on rear vertical wall 74.

While the present invention has been described with respect to the exemplary embodiments thereof, it will be recognized by those of ordinary skill in the art that many modifications or changes can be achieved without departing from the spirit and scope of the invention. Therefore it is manifestly intended that the invention be limited only by the scope of the claims and the equivalence thereof.

I claim:

1. A hinge lid cigarette pack incorporating a lift mechanism for raising smoking articles contained therein, said cigarette pack comprising:

an outer housing having opposing front and rear walls, opposing side walls, and a bottom wall;

a hingeable prismatic lid secured along a seam to said rear wall of said housing;

an insertable sleeve having opposing front and rear walls, and opposing side walls, said insertable sleeve slidably receivable within said outer housing, said rear wall of said sleeve extending above said seam formed between said hingeable lid and said rear wall of said outer housing, said rear wall of said sleeve formed with a guide notch therein;

a plurality of smoking articles encapsulated in foil wrap and slidable inserted into said sleeve and said outer housing, an upper portion of said foil being tearably removable for access to said smoking articles;

a lifting mechanism for elevating a portion of said smoking articles for ease of grasp for removal, said lifting mechanism comprising a horizontal plate member disposed below lower ends of a portion of said smoking articles, at least one vertical plate member secured to said horizontal plate member and disposed between a portion of said smoking articles and said foil, and said rear wall of said sleeve, said lifting mechanism having a flexibly taut cord secured thereto, said cord extending upwardly between said smoking articles and said foil, through said foil and over said rear wall of said insertable sleeve via said guide notch to a securing strip secured to an inner upper surface of said hingeable lid, the opening of said hingeable lid elevating said lifting mechanism and said smoking articles in abutment thereto.

2. The cigarette pack incorporating a lift mechanism in accordance with claim 1 wherein said lift mechanism is L-shaped in cross sectional area having a single rear vertical plate member.

3. The cigarette pack incorporating a lift mechanism in accordance with claim 1 wherein said lift mechanism is generally U-shaped in cross section having a planar bottom member juxtaposed said lower ends of said smoking articles and two upstanding vertical members juxtaposed the front wall and rear wall of said foil wrap and said insertable sleeve.

4. The cigarette pack incorporating a lift mechanism in accordance with claim 1 wherein said guide notch is Y-shaped and centrally disposed on said rear wall of said insertable sleeve, said guide notch acting as a pulley for said lift mechanism.

5. The cigarette pack incorporating a lift mechanism in accordance with claim 1 wherein said securing strip on said hingeable lid is an adhesive strip adhesively securing said flexible taught cord to said hingeable lid.

6. The cigarette pack incorporating a lift mechanism in accordance with claim 1 wherein said lift mechanism is fabricated from a rigid polymer.

7. The cigarette pack incorporating a lift mechanism in accordance with claim 1 wherein said lift mechanism is fabricated from a thin gauge metal.

8. The cigarette pack incorporating a lift mechanism in accordance with claim 1 wherein said flexibly taut cord is secured to said horizontal plate member of said lifting mechanism.

9. The cigarette pack incorporating a lift mechanism in accordance with claim 1 wherein said flexibly taut cord is secured to said vertical plate member of said lifting mechanism.

* * * * *